US005145344A

United States Patent [19]

Haga et al.

[11] Patent Number: 5,145,344

[45] Date of Patent: Sep. 8, 1992

[54] SCROLL-TYPE FLUID MACHINERY WITH OFFSET PASSAGE TO THE EXHAUST PORT

[75] Inventors: Shuji Haga; Masatomo Tanuma, both of Yokohama, Japan

[73] Assignee: Iwata Air Compressor Manufacturing Co. Ltd., Tokyo, Japan

[21] Appl. No.: 654,184

[22] Filed: Feb. 13, 1991

[30] Foreign Application Priority Data

Feb. 13, 1990 [JP] Japan ..... 2-29428
Mar. 23, 1990 [JP] Japan ..... 2-72040

[51] Int. Cl.[5] ..... F04C 18/04

[52] U.S. Cl. ..... 418/55.2; 418/55.3; 418/55.4; 418/60

[58] Field of Search ..... 418/55.2, 55.3, 55.4, 418/60

[56] References Cited

U.S. PATENT DOCUMENTS

| | | | |
|---|---|---|---|
| 2,841,089 | 7/1958 | Jones | 418/55.2 |
| 4,157,234 | 6/1979 | Weaver et al. | 418/55.2 |
| 4,883,413 | 11/1989 | Perevuznik et al. | 418/55.4 |
| 4,969,810 | 11/1990 | Stolle et al. | 418/55.4 |
| 5,024,589 | 6/1991 | Jetzer et al. | 418/55.3 |

FOREIGN PATENT DOCUMENTS

| | | | |
|---|---|---|---|
| 3140512 | 4/1983 | Fed. Rep. of Germany | 418/55.4 |
| 3524684 | 5/1986 | Fed. Rep. of Germany | 418/55.4 |
| 3610721 | 10/1986 | Fed. Rep. of Germany | 418/55.4 |
| 3538522 | 12/1986 | Fed. Rep. of Germany | 418/55.3 |
| 60-104787 | 6/1985 | Japan | 418/55.3 |
| 63-42081 | 8/1988 | Japan . | |
| 1-167482 | 7/1989 | Japan | 418/60 |

*Primary Examiner*—John J. Vrablik
*Attorney, Agent, or Firm*—Foley & Lardner

[57] ABSTRACT

A scroll-type fluid machine has an orbiting scroll with involute wraps projecting axially on each of opposite sides, a pair of stationary scrolls each with involute wraps which mate with the wraps of the orbiting scroll, and a main shaft inserted in a central axis hole of the stationary scrolls for driving the orbiting scroll in orbital movement. The internal ends of the wraps of the stationary scrolls are extended inwardly to an outer peripheral wall of a land part where the central axis hole is formed. The stationary scroll wraps are extended about a half turn longer than the wrap of the orbiting scroll and the internal ends of the wraps are almost in contact end to end at a desired phase during the orbiting movement of the orbiting scroll.

1 Claim, 5 Drawing Sheets

SCROLL-TYPE FLUID MACHINERY WITH OFFSET PASSAGE TO THE EXHAUST PORT

BACKGROUND OF THE INVENTION

1. Field of the Invention

This invention relates to scroll-type fluid machinery functioning as compressors, expanders or vacuum pumps, and more particularly to twin unit scroll-type fluid machinery having stationary scrolls axially disposed on both sides of an orbiting scroll.

2. Description of the Prior Art

Scroll-type compressors which are known in the art comprise: a stationary scroll having a first wrap formed in an involute spiral located within a casing which encloses all members thereof, a peripheral wall provided with a suction port and an exhaust port at a peripheral region and a central region thereof, respectively, an orbiting scroll having a second wrap also formed in an involute spiral, the second wrap mating with the first wrap at least in a pair of line contacts thereby forming a pocket between the line contacts of the first and second wraps, wherein, when the orbiting scroll is driven with an orbital movement rather than a rotational movement, air is taken through the suction port into the pocket whose volume is reduced as it moves along the scroll surfaces to the central region, the compressed air being discharged through the exhaust port. There is disclosed in U.S. Pat. No. 4,129,405 single unit scroll-type machinery for expanding, compressing or displacing fluid with a stationary scroll and an orbiting scroll interfitted to each other. U.S. Pat. No. 4,192,152, and Japanese Patent Publication 63-42081 disclose twin unit scroll-type machinery for expanding, compressing or displacing fluid with a pair of stationary scrolls, each having a wrap inside, and with an orbiting scroll having wraps on both sides which are interfitted respectively with the mating wraps of the stationary scrolls.

In either of the scroll-type machineries above, however, problems arise at the suction port and the exhaust port, because each of the wraps of the stationary scroll and the orbiting scroll is formed with the same number of turns, the wraps being engaged with a 180 degree phase difference.

That is, in the region of the suction port, there has to be provided another suction port 180 degrees apart from the first suction port, where each beginning end of the wraps contacts the other wrap side walls and forms one of the contact lines of the pockets, or there has to be provided a half-way detour passage circumferentially around the periphery of the wraps which connects the suction port with the other side of the contact line 180 degrees apart therefrom. These problems result in machinery that is large in size and sophisticated in machining and assembling processes.

The two suction ports, further, means there are two pockets 180 degrees apart which are hard to simultaneously compress, thereby requiring double power, and reducing the intake efficiency because the fluid volume sucked in the pockets is limited by the port area and the detour passage.

The problem in the region of the exhaust port, on the other hand, resides in the large volume of the pockets at the central portion, where an eccentric shaft has to be provided axially parallel with a drive shaft to drive the orbiting scroll together with a bearing thereof, where the exhaust port and a terminal wrap end have to be provided at the peripheral circumference of the bearing, and where the involute spiral terminates before reaching the center thereof, without shortening the spiral's length in order to obtain smaller pocket volume because there has to be disposed a pair of terminal wrap ends 180 degrees apart. Thus, conventional machineries result in the pocket volume released at the exhaust port remaining so large as not to attain a maximum compression ratio. What is worse, the greater volume of the pocket at the last stage makes the sealing line longer, making leakage easier, and the resulting compression efficiency lower.

To solve these failures, in a single unit scroll-type machine, an arrangement may be provided wherein a main shaft to drive an orbiting scroll is disposed at the back surface thereof, and an exhaust port is provided at the center of a stationary scroll. Whereas, in the twin unit scroll-type machine as shown later in the embodiment of the present invention, the main shaft to drive the orbiting scroll has to be disposed through the stationary scrolls at the center thereof, because the orbiting scroll has to be oppositely interfitted with the stationary scrolls so as to arrange a pair of stationary scrolls at both sides of the orbiting scroll, wherein it is necessary that the exhaust port and the terminal wrap ends have to be disposed at the peripheral circumference of the bearing where the involute spiral terminates before reaching the center thereof.

In either scroll-type machine, because the wrap ends slide on the opposite mirror surface, lubricated with grease, in substantial surface contact in order to compress the fluid, the scrolls opposing each other have to be aligned parallelly and axially within a strict limitation.

A plurality of thrust adjusting means are provided to solve the problem in either scroll-type machine. At the peripheral wall of the stationary scroll opposite to the orbiting scroll, which wall is located outside of the wrap space where the compression is effected, three sets of slave crank shafts are provided in a 120 degree distribution, for example, whereby the parallel alignment of the scrolls and the thrust adjustment is effected.

Because the twin unit scroll-type machine above, however, is formed whereby the orbiting scroll is interfitted with a pair of stationary scrolls at either side, the thrust adjusting means must be provided at each of the stationary scrolls in order to adjust the thrust through the orbiting scroll commonly held at both sides thereof. Thus, if the thrust of one side of the stationary scroll is adjusted, then the thrust already adjusted on the other side of the stationary scroll becomes deviated.

Therefore, as in Japanese Patent Publication 63-42081, utilizing a main shaft which drives the orbital scroll disposed coaxially with a pair of stationary scrolls, and a plurality of eccentric shafts to restrict a rotational movement, the scrolls are intended to be precisely assembled in a unit with bearings, a casing and so forth, to avoid misalignment of the scrolls with each other, and misalignment of the thrust. The arrangement of the three scrolls with the main shaft and the eccentric shafts assembled in one unit with a plurality of parallel axes does not allow the orbiting scroll to have the slightest axial deviation. Even if the deviation may be allowed within some extent, another failure arises in that the tolerance may require further shaft power.

Though the twin unit scroll-type fluid machine has been believed to have a great advantage due to its small size, resulting from the compression procedure available at both sides of the orbiting scroll, and forming a two stage compressor with a higher compression ratio, hence, with a better power efficiency, the twin unit machine has not been completely successful because of the troublesome issues discussed above.

SUMMARY OF THE INVENTION

Objects of the Invention

It is, therefore, a primary object of the present invention to provide in particular a twin unit scroll-type fluid machine easily capable in practical use of resolving the failures of the prior art.

It is another object of the present invention to provide a scroll-type fluid machine small in size with a higher suction/exhaust volume ratio and a higher compression pressure.

It is still another object of the present invention to provide a scroll-type fluid machine with an advanced sealing means and an advanced compression efficiency or expansion efficiency.

It is still another object of the present invention to provide a scroll-type fluid machine, particularly a twin unit machine with a reasonable tolerance in assembly alignment and a machining deviation range not so strict as formerly required, wherein the tolerance is absorbed to maintain the tangential sealing between the wraps, and the radial sealing between the scroll ends and the mirror wall surfaces opposing thereto, wherein a desired compression efficiency or expansion efficiency is attainable.

It is yet another object of the present invention to provide a scroll-type machine, capable of precise self-alignment in parallel and capable of self-adjustment of the distance between the scrolls during the orbital movement thereof.

It is still another object of the present invention to provide a scroll-type fluid machine, absorbable precisely of an axial misalignment of the orbiting scroll, capable of compression or expansion as desired, without increasing the shaft power unnecessarily.

A feature of the present invention, in a twin unit scroll-type fluid machine having a main shaft for driving an orbiting scroll, which main shaft is disposed through a plurality of bearings into a pair of stationary scrolls, resides in a stationary scroll wrap which is extended approximately another half turn more than a wrap of the orbiting scroll toward the center region and/or the peripheral region, (instead of as in conventional machines wherein wraps with the same number of turns are 180 degrees apart,) wherein each of the wraps of the stationary scroll and the orbiting scroll is able to almost contact each other end to end during the orbit movement of the orbiting scroll.

The present invention is applicable not only to the twin unit as above, but also a single unit scroll-type fluid machine wherein a stationary scroll is disposed with a main shaft at the center thereof.

An arrangement reverse to the above may also be possible, that is, to form the wrap of the orbiting scroll more than a half turn longer than that of the wrap of the stationary scroll.

Referring to FIGS. and 2, the function of the present invention will be described separately on the suction portion and the exhaust portion of the compressor hereinafter.

The suction portion at the peripheral region, firstly, because an external wrap end(10*b*) of a stationary scroll(2) is extended a half turn more than that of the orbiting scroll, the wrap ends(10*b*, 15*b*) come in contact with each other where a suction port(8) is provided. The single port(8), instead of providing two suction ports located 180 degrees apart, or instead of providing a detour passage between contacting lines 180 degrees apart as in the conventional machine, allows the machinery to be small in size and to save machining steps.

The first pocket(30B) between the first and the next contact lines is larger than the conventional one, because the external wrap end(10*b*) of the stationary scroll(2) is extended 180 degrees, which increases the intake efficiency as well. Referring to FIG. 2(*a*), the single pocket(30B) for the initial intake through the single suction port(8) has a greater volume than the divided volume of the two pockets in the conventional one, is continuously compressed reducing the volume from the suction portion to the exhaust portion, whereby it makes it possible to increase the compression ratio and the exhaust pressure, too.

At the exhaust portion, secondly, an internal wrap end(10*a*) of a stationary scroll(2) is extended a half turn relative to an internal wrap end(15*a*) of orbiting scroll(1) in an involute spiral toward the periphery of the bearing to form an arrangement in which the internal wrap ends(10*a*, 15*a*) come into contact with nearly end to end alignment during the orbital movement of the orbiting scroll(1), whereby in the final stage the pocket(30A) has a smaller volume, and hence, the advanced exhaust efficiency and the higher compression ratio can be achieved (FIGS. 1 and 2(*a*)).

It is preferable, as shown in FIG. 1, to dispose the wrap end(10*a*) of the stationary scroll(2) at a peripheral circumference wall(4*a*) forming a land part(4) for a central axis hole(2*a*).

The internal wrap end(15*a*) of the orbiting scroll(1), as shown in FIG. 1, is disposed at the dead end(21*a*) of the scroll groove(21) of the stationary scroll between the peripheral circumference wall(4*a*) of the land part(4) forming the central axis hole(2*a*) and a wrap(10*c*) next to the wrap(10*a*) thereof, of which the dead end wall(21*a*) of the scroll groove(21) is formed in an arc of a half circle with which the internal wrap end(15*a*) of the orbiting scroll(1) is slidably in contact, whereby the sealing between the internal wrap end(15*a*) and the dead end wall(21*a*) of the scroll groove(21) is secured.

It is preferable to form the dead end wall(21*a*) of the scroll groove(21) in the arc of a half circle with a radius(x) almost the same as the distance of the eccentricity—a distance between the center(1*a*) of the axis hole for the orbiting scroll(1) and the center(2*a*) of the axis hole for the stationary scroll(2), or in other words, an orbiting radius(x).

In order to apply the present invention to compressors, an exhaust port(7) is provided at the dead end wall(21*a*) of the scroll groove to discharge the fluid, wherein the final stage of the pocket has the smallest volume in order to secure the compression efficiency.

It is further recommendable, as in FIG. 2, to provide the exhaust port(7) at some distance on the land part(4) away from the dead end wall(21*a*) of the scroll groove(21), instead of next thereto, connecting through a passage(31), to obtain a further improved compression efficiency.

As described in the earlier statement, a smaller volume pocket at the final stage provides a shorter sealing line which assures a better sealing effect, and prevents a returning flow of the fluid, resulting in further improving the compression efficiency.

Thus, the arrangement above provides the improved intake/exhaust efficiency at both the suction port(8) and exhaust port and a better sealing performance. In the twin unit, however, the improved efficiency is not realized if the scrolls are not disposed in parallel to each other, if the distances between them are not kept precisely, and if those alignments are not adjustable easily.

The present invention, therefore, as shown in FIG. 4, provides a twin unit scroll-type fluid machine which comprises: an orbiting scroll(1) disposed with a main shaft(5) axially movable relative to stationary scrolls(2A, 2B) within a short distance, a sealing member(9) disposed at least in a groove at the wrap ends (101, 151) of the orbiting scroll(1) resiliently forced evenly against mirror surfaces(11*a*, 21*a*) of the stationary scrolls(2A, 2B), wherein the interfaces between the mirror surfaces and the wrap ends(101, 151) are formed capable of being sealed with the sealing member(9).

It is not restrictively intended to seal the interface with the sealing member(9) alone, but an oil lubricant may be used as a sealant cooperatively.

The means for resiliently forcing evenly the sealing member(9) may be realized with either a sealing member(9) made of a resilient material as in an enlarged drawing FIG. 3(*a*), or with a sealing member(9) with a resilient member(91) disposed in a seal groove(90) of the wrap end as in FIG. 3(*b*).

The invention above, because the orbiting scroll(1) is axially movable within the desired distance, and because the sealing members(9) are inserted in the groove at the wrap ends(101, 151) of the orbiting scroll(1) to uniformly press on the opposite mirror surfaces(11*a*, 21*a*), provides a feature wherein thrust force on the interface due to the machining deviation and misalignment in the assembly process are compensated with the resilient force of the member, and thus, self-alignment can be achieved.

In other words, even if there is machining deviation and assembly misalignment, the adjustment for the center of orbiting scroll(1) is self-accomplished without any manual axial adjustment or realignment.

Further to the above, because the sealing member(9) is elastic or is variable in length, the sealing member(9) easily absorbs the axial deviation of the orbiting scroll(1).

Still adding to the above, as the orbiting scroll(1) is resiliently interfitted through the sealing member(9) between the stationary scrolls(2A, 2B), instead of being fixedly disposed, the shaft power does not uselessly increase.

The simple arrangement above, therefore, according to the present invention, gives the high compression efficiency and the advanced sealing performance around the wrap ends at either sides of the suction and exhaust portion and interfaces with other scrolls anywhere between thereof.

The description above is associated with the arrangement and function of compressors, but it is obviously understandable that the present invention is easily applicable to fluid positive displacement pumps and expanders.

BRIEF DESCRIPTION OF THE DRAWINGS

FIGS. 3(*a*) and 3(*b*) are longitudinal cross sectional detailed views of a portion of the sealing members.

DETAILED DESCRIPTION OF THE PREFERRED EMBODIMENT

Preferable embodiments of the present invention will be illustratively described in detail with reference to the above drawings. It is, however, not intended to restrict the scope of the present invention within the dimensions, materials, shapes, relative positions, etc. of the constitutional parts in the embodiments, but is merely aimed to an illustrative purpose, unless otherwise specified.

Figure 1:
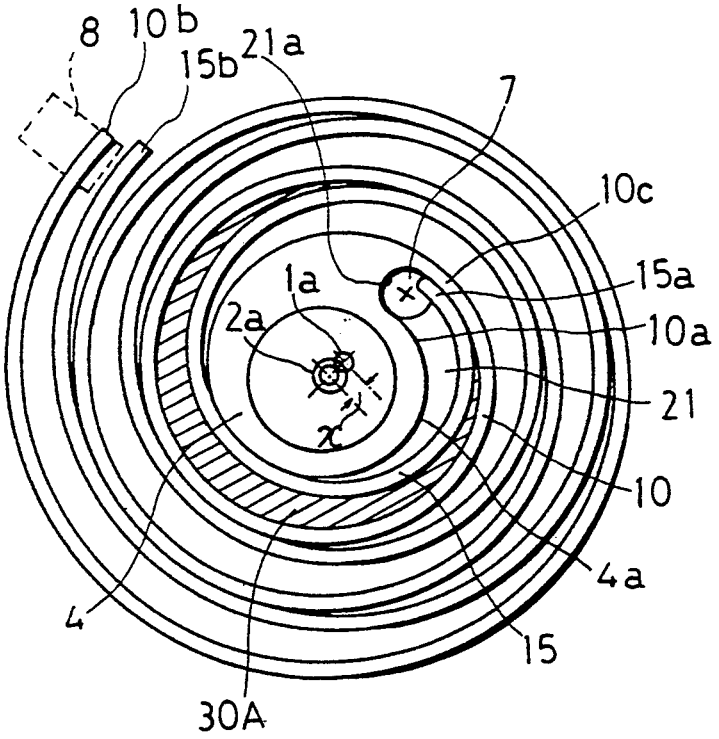
FIGS. 1, 2(*a*) an 2(*b*) are top plan sectional views of an embodiment of one set of wraps showing their schematic forms and arrangements constructed in accordance with the present invention.
Figure 2A:
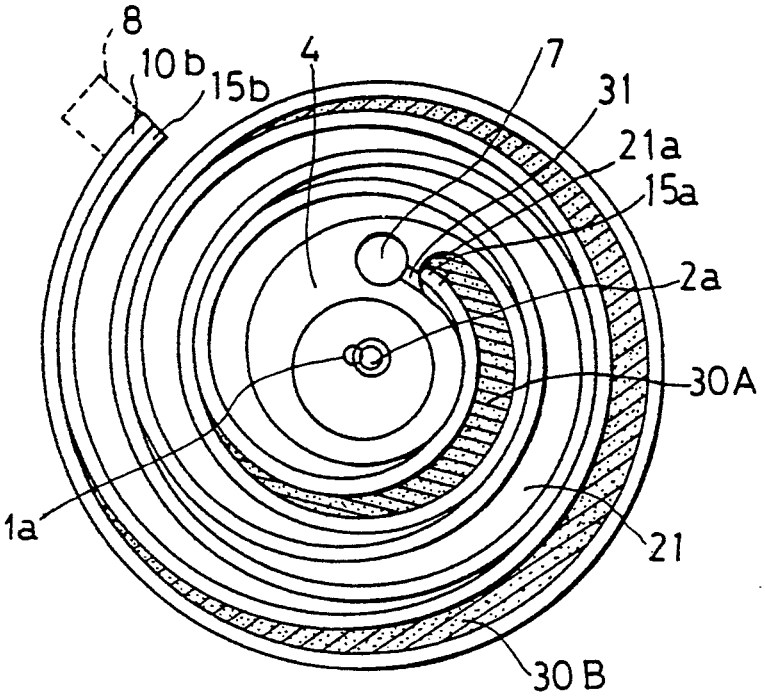
Figure 2B:
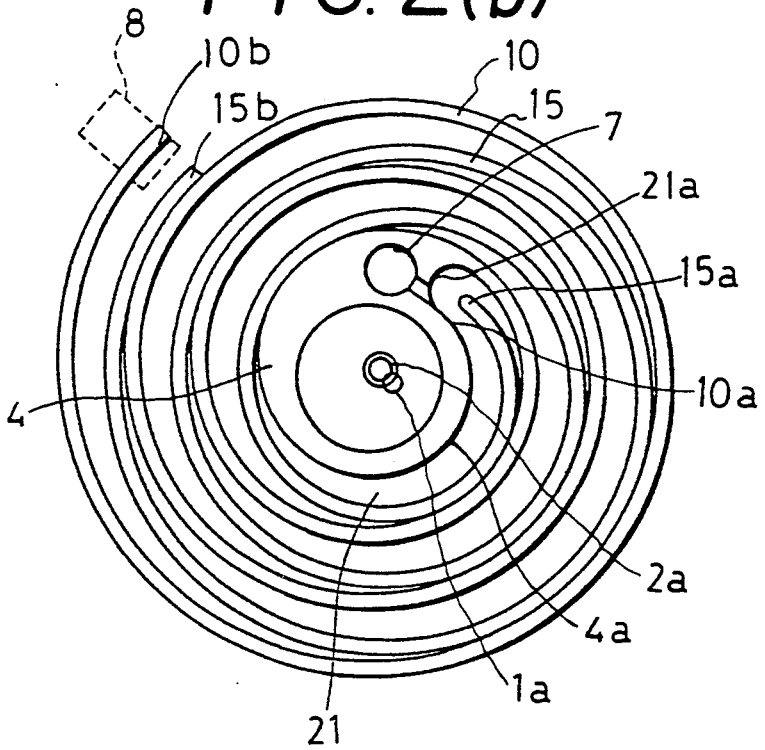

FIGS. 1 and 2 are views showing wraps of a scroll-type compressor which are the primary arrangement of the present invention. Referring to FIG. 1, reference numeral (10) indicates a wrap formed inside of a stationary scroll(2A or 2B), forming a spiral involute of $3\frac{3}{4}$ turns started from a peripheral wall(4*a*) of a land part(4) for a central hole for a stationary axis(2*a*) of a main shaft(5) provided at the central portion, having a dead end wall(21*a*) of a scroll groove(21) formed in an arc of a half circle starting from a wrap start end(10*a*) at the land part wall(4*a*) to a wrap(10*c*) next to the wrap start end(10*a*), of which the dead end wall(21*a*) has an exhaust port(7), or a passage connected to outside members. The dead end wall(21*a*) is formed with a radius almost the same as the eccentricity distance(x) between centers of an orbiting scroll axis(1*a*) and the stationary scroll axis(2*a*).

A wrap(15) for an orbiting scroll(1), on the other hand, forms a spiral involute of $2\frac{3}{4}$ turns, a 180 degree turn shorter than the stationary scroll wrap(10) at start and terminal ends respectively. The orbiting scroll wrap start end(15*a*), having a section rounded circular end, is in slidable contact with the circular surface of the dead end wall(21*a*) of the scroll groove (21) during the orbital movement of the orbiting scroll(1). As the orbiting scroll(1) rotates around the stationary scroll center(1*a*), the wrap start end(15*a*) of the orbiting scroll slidably moves along the dead end wall(21*a*), whereby a pocket(30A) is kept compressed until the wrap start end(15*a*) reaches the inlet edge of the exhaust port(7), with a final volume of 24% less and a sealing line of 33% less than that of a conventional pocket which has been released 180 degrees behind the exhaust port(7), thus, achieving a higher compression efficiency.

Because the exhaust port(7) is provided at the dead end wall(21*a*) in the above embodiment, the final pocket(30A) is released as soon as the wrap end(15*a*) reaches the inlet edge of the exhaust port(7), or it contacts with the next wrap(10*c*). To solve the above problem, the exhaust port(7) can be provided, as in FIG. 2, at the land port(4) ahead of the dead end wall(21*a*) with a passage(31) connecting the dead end wall(21*a*) and the port(7).

In this arrangement, the final pocket(30A) is held until the wrap end(15*a*) nearly reaches the wrap start end(10*a*) or the land part wall(4*a*), with a final volume of 11% less and a sealing line of 24% less than that of the above embodiment, whereby a further improved compression ratio is recognized.

A wrap terminal end(10*b*) of the stationary scroll, in the embodiment, is also extended another 180 degree turn, and is in contact with the wrap terminal end(15*b*) of the orbiting scroll thereby forming one of the contact lines of the pocket(30B). A suction port(8) is formed on the stationary scroll(2), wherein the great volume of the pocket(30B) and one intake port of the suction port(8) help accomplish the intended features.

Figure 3C:
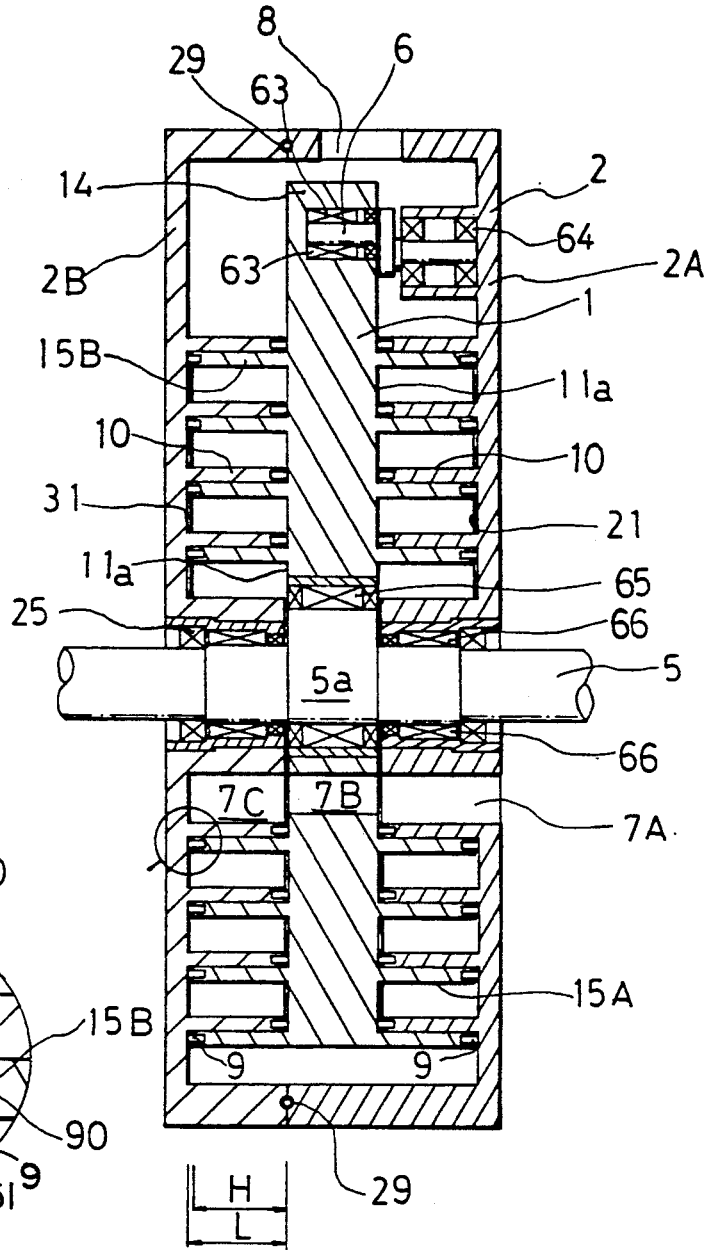
FIG. 3(*c*) is a longitudinal sectional view of a twin unit scroll-type fluid machine constructed in accordance with the present invention.
Figure 3A:
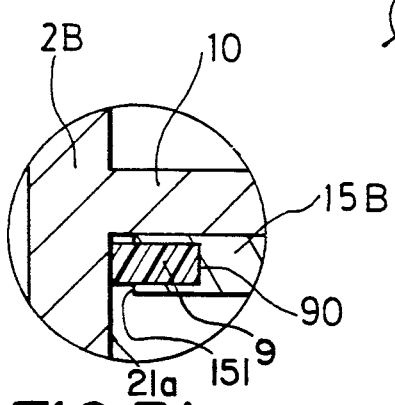
Figure 3B:
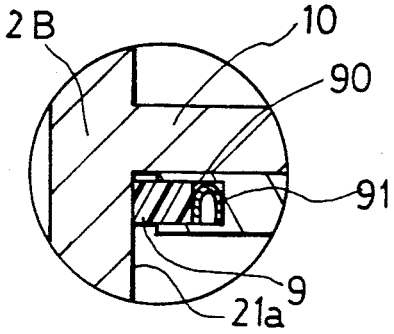
Figure 4:
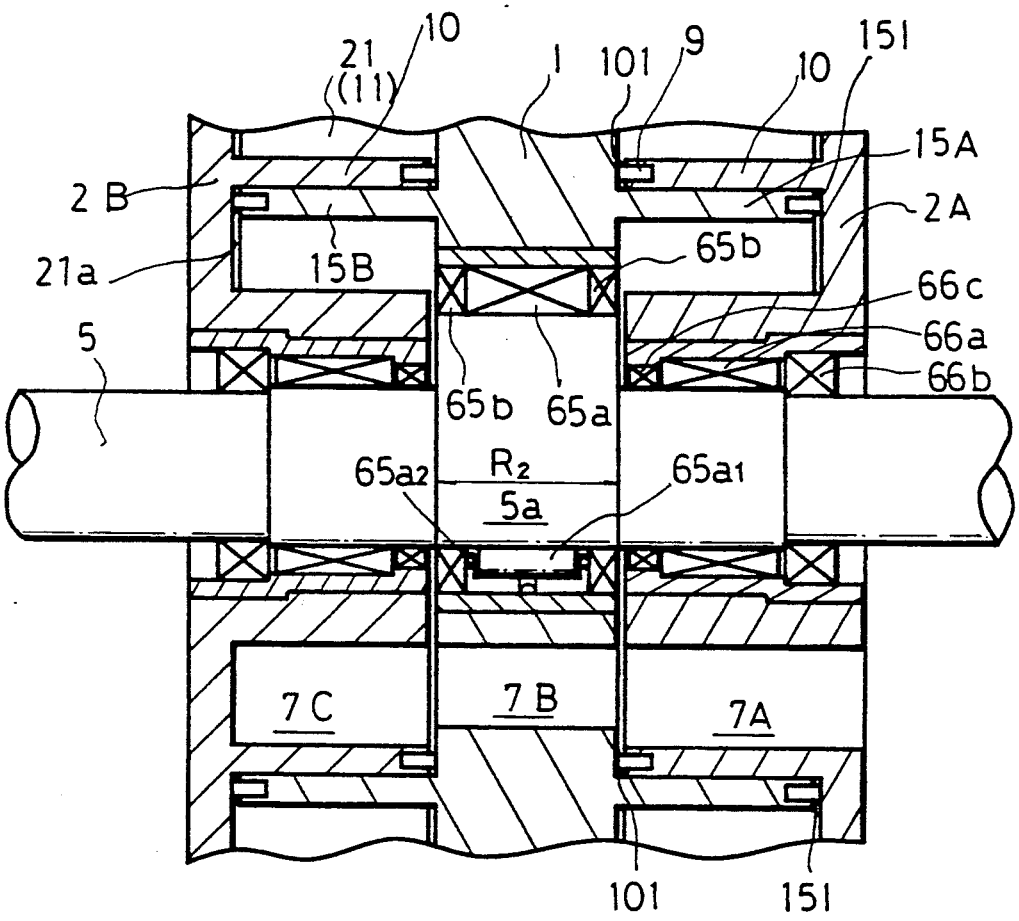
FIG. 4 is a partial longitudinal section view showing a portion of the center shaft.
Figure 5:
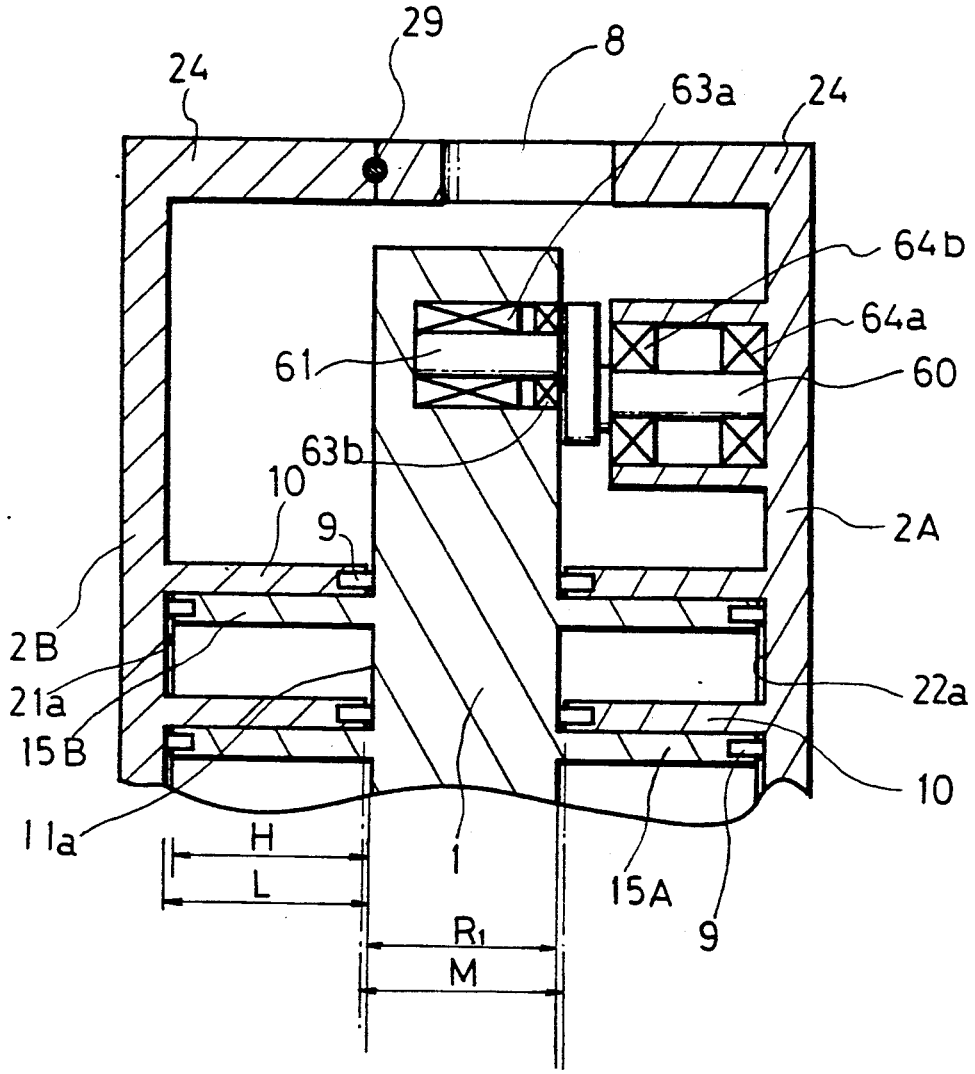
FIG. 5 is a partial longitudinal section view showing a portion of the orbiting shaft.

In FIGS. 3 through 5, an oilless scroll-type compressor with the arrangement of the wraps of the present invention is provided which comprises: an orbiting scroll(1) provided with a pair of orbiting wraps(15A, 15B) axially parallel to a main shaft(5), of which the crank portion(5*a*) supports the orbiting scroll(1), a pair of stationary scrolls(2A, 2B) formed with stationary wraps(10) inside thereof mating with the orbiting wraps(15A, 15B) respectively, and three sets of slave crank shafts(6) for restriction of rotational movement are disposed 120 degrees apart at outer walls(14, 24) which enclose an outer scroll room, wherein the slave crank shafts(6) connect the orbiting scroll(1) and one of the stationary scrolls(2A).

The stationary scrolls(2A, 2B) form a circular cap, of which the outer walls(24, 24) are disposed oppositely and interfitted with a sealing member(29) to form a casing for sealing the space therein. The center axis hole is inserted with a main shaft(5) through bearings(25, 66) to support rotatably the stationary scrolls. Stationary wraps(10, 10) forming spiral involutes are symmetrically disposed oppositely around the bearings(25, 66). The stationary scroll(2A) is provided with a suction port(8) at the peripheral wall(24) and an exhaust port-(7A) at the central portion.

On the other hand, as mentioned earlier, the orbiting scroll(1) is axially parallelly provided with orbiting wraps(15A, 15B) on both surfaces thereof, wherein the orbiting wraps(15A, 15B) mate with the stationary wraps(10, 10). The orbiting scroll(1) is also axially supported with three shafts(61), each one a side shaft of the slave crank shafts(6).

The slave crank shafts(6, 6, 6), as known in the prior art, are axially disposed in a 120 degree distribution for arranging the three of them at a circumferential distance from the center axis of the main shaft(5), of which one set of side shafts(61, 61, 61) is axially disposed at the orbiting scroll(1), and of which the other set of side shafts(60, 60, 60) is axially disposed at the stationary scroll(2A), through bearings (63, 64). As the main shaft(5) is rotationally driven, the slave crank shafts(6, 6, 6) are rotated with the rotation of the main shaft(5) with an orbital radius(x) corresponding to an eccentricity distance(x) of the main shaft(5). Thus, the slave orbiting shafts(6, 6, 6) enable the orbiting scroll(1) not to rotate on the stationary scroll axis(2*a*), but to orbit with the radius(x) around the axis(2*a*).

The arrangement of the slave orbiting shafts is known in the art, therefore, further description will be discontinued. However, a feature of the present invention resides in the arrangement, as in FIG. 3, to axially dispose only one side of the shafts(6, 6, 6) at one(2A) of the stationary scrolls(2), whereby a slight axial misalignment of the orbiting scroll(1) is absorbed to prevent a useless increase of the shaft power.

When the slave orbiting shaft(6) is axially supported at both extensions with the stationary scrolls(2A, 2B) interfitting the orbiting scroll(1) therebetween, there arises an unfavorable problem, namely an increase in the shaft drive power due to the axial misalignment of the orbiting scroll(1), which cannot be absorbed, resulting finally in a solid construction.

Referring to FIGS. 4 and 5, the arrangement of the bearing portion for the main shaft(5) and slave shaft(6) will be described hereinafter. A bearing(65) holding a central eccentric shaft(5*a*) of the main shaft(5), comprises a conventional needle bearing(65*a*) consisting of a number of needle bearings(65*a*1) enclosed within a casing(65*a*2), and a pair of oilseals(65*b*) arranged at either ends thereof, wherein the space between the oilseals(65*b*, 65*b*) is filled with grease. Another bearing(66), as in FIG. 3, holds the main shaft(5) at the stationary scroll(2A), and comprises a sealing angular bearing(66*b*), a needle bearing(66*a*) enclosed in a casing, and an oilseal(66*c*) as in FIG. 4, wherein the sealed space is filled with grease. As in FIG. 5, a bearing(64) holding the stationary scroll side(60) of the slave orbiting shaft(6) comprises a pair of sealing angular bearings(64*a*, 64*b*), wherein the sealed space between thereof is filled with grease as well.

In the arrangement above, because the needle bearings(63*a*) for the orbiting scroll(61) of the slave orbiting shaft(6), and the needle bearings(65*a*, 66*a*) for the eccentric shaft(5*a*) and the main shaft(5) are formed with a slight axial play within the casings(65*a*2, . . . ) thereof, the play allows the orbiting scroll(1) to move axially. A square groove(90) along the spiral involute, as in FIG. 3, is provided in the middle of the end surfaces(101, 151) which oppose the mirror surfaces(11*a*, 21*a*) of opposed scroll grooves(11, 21), wherein each string of plastic seal member(9) made of a self-lubricant plastic material is disposed in every square groove(90) to be resiliently in contact with the mirror surfaces(11*a*) on both sides of the orbiting scroll(1) and the mirror surfaces(21*a*) inside of the stationary scrolls(2A, 2B).

As shown in FIG. 5, the projection length(H) of the wraps is formed slightly shorter than the distance(L) between the mirror surfaces(11*a*, 21*a*) of the scrolls(1, 2A, 2B), and the wall thickness(R1) of the orbiting scroll and the width(R2) as in FIG. 4) of the eccentric shaft(5*a*) are also formed slightly shorter than the distance(M) between the wrap ends(11) of the stationary scrolls(2A, 2B). In other words, a clearance assures the axial slide movement of the orbiting scroll, and also enables the resilient interfitting, that is, the clearances between the scroll grooves(11*a*) of the orbiting scroll(1) and the scroll ends(101) of the stationary scrolls(2A, 2B), and the clearances between the scroll ends(151) and the scroll grooves(21*a*, 22*a*) of the stationary scrolls(2A, 2B).

In the embodiment above, the resilient thrust forces of the sealing members(9) result in self-alignment even if the orbiting scroll(1) is in misalignment, for example, tilted or shifted with respect to other members.

In a conventional embodiment wherein three sets of slave orbiting shafts(6) were rotatably disposed with stationary scrolls (2A, 2B) interfitted with an orbiting scroll therebetween, in which both ends of the slave orbiting shafts(6) were supported therewith, the shaft drive power was increased due to the tilting and shifting of the orbiting scroll(1), of which misalignment was not tolerable, and resulted in rigid joining.

The present invention is as shown in FIG. 5, wherein the slave orbiting shafts(6) are rotatably disposed on only one side of the scrolls, i.e. on the stationary scroll- (2A), which absorbs the tilting and shifting misalignment, to save the useless increase of the shaft power.

Further to the arrangement of the sealing members(9) made of a resilient plastic material, another arrangement is as shown in FIG. 3(*b*) which has confirmed the same performance, whereby the resilient thrust force has been absorbed with a resilient member(91) disposed in the seal groove(90) together with a seal member(9).

What is claimed is:

1. A scroll-type fluid machine comprising:

an orbiting scroll with first and second involute wraps projecting axially on each of opposite sides thereof;

first and second stationary scrolls each with an involute wrap which mates with a respective one of said first and second wraps of said orbiting scroll, said stationary scroll wraps having internal ends which extend to an outer peripheral wall of a central land part of the respective stationary scrolls, and said land parts having a central axis hole formed therein; and a main shaft disposed in said central axis hole for driving said orbiting scroll in orbital movement;

wherein said stationary scroll wraps are extended about a half turn longer than the wraps of the orbiting scroll;

wherein ends of said orbiting scroll wraps are almost in end to end contact with corresponding ends of the mating stationary scroll wraps at a desired phase during the orbital movement of said orbiting scroll, and wherein the outer peripheral wall of the land part and the involute wrap of each stationary scroll define a scroll groove with an inner dead end, and an exhaust port is formed in said land part connected to said scroll groove dead end through a passage opening at a position on said land part outer periphery disposed inwardly of a central involute line in said scroll groove.

* * * * *